US005330080A

United States Patent [19]

O'Connor

[11] Patent Number: 5,330,080

[45] Date of Patent: Jul. 19, 1994

[54] BEVERAGE DISPENSER AND STAND THEREFORE FOR USE WITH BEVERAGE CONTAINING BOTTLES

[76] Inventor: John L. O'Connor, 105 McMakin Manor Dr., LaGrange, Ky. 40031

[21] Appl. No.: 5,656

[22] Filed: Jan. 19, 1993

[51] Int. Cl.[5] ..... B67D 5/06

[52] U.S. Cl. ..... 222/181; 222/481.5; 222/483; 248/121

[58] Field of Search ..... 222/129, 181, 185, 481.5, 222/484, 325, 482, 483, 485, 506; 248/121, 146; 211/74

[56] References Cited

U.S. PATENT DOCUMENTS

| | | | |
|---|---|---|---|
| 1,017,756 | 2/1912 | Head | 222/484 |
| 2,341,950 | 2/1944 | Schepps | 222/185 |
| 2,440,112 | 4/1948 | Nellson | 222/484 |
| 3,376,582 | 4/1968 | Samuels | 222/488 |
| 3,710,981 | 1/1973 | Arzberger et al. | 222/506 |
| 3,837,542 | 9/1974 | Por | 222/481.5 |
| 3,945,524 | 3/1976 | Tkaciukas | 222/181 |
| 4,269,333 | 5/1981 | Nakai et al. | 222/506 |
| 4,638,923 | 1/1987 | Mines, Jr. et al. | 222/325 |
| 4,715,516 | 12/1987 | Salvail | 222/481.5 |
| 4,722,463 | 2/1988 | Anderson | 222/185 |
| 4,807,785 | 2/1989 | Pritchett | 222/484 |
| 4,844,290 | 7/1989 | McCurdy et al. | 222/484 |
| 4,928,861 | 5/1990 | Schiemann | 222/481.5 |
| 4,974,753 | 12/1990 | Tucker et al. | 222/181 |
| 4,978,036 | 12/1990 | Burd | 222/181 |
| 5,172,831 | 12/1992 | Burrows | 222/484 |

*Primary Examiner*—Andres Kashnikow
*Assistant Examiner*—Philippe Derskshani
*Attorney, Agent, or Firm*—Camoriano & Smith

[57] ABSTRACT

An apparatus for dispensing liquids directly from a vertically oriented inverted container comprises a body to secure to the mouth of the container. The body defines a pair of first and second chambers that communicate with a pair of first and second passageways. A pair of valves is adapted to selectively open and close the first and second chambers. Finally, a valve control mechanism is operative linked to the valves and sequentially opens the second valve and the first valve.

9 Claims, 4 Drawing Sheets

BEVERAGE DISPENSER AND STAND THEREFORE FOR USE WITH BEVERAGE CONTAINING BOTTLES

TECHNICAL FIELD

This invention relates to an apparatus and stand for the selectively dispensing of carbonated and uncarbonated beverages from a disposable bottle.

BACKGROUND OF THE INVENTION

One of the common complaints of individuals or entities about group events where beverages are served from bottles such as the one and two liter soft drink bottles to a large number of guests or patrons is the time involved in serving each individual. Unless the server uses expensive beverage serving equipment, for example, pump or pressure driven devices such as often found in taverns or the like, considerable time is involved in identifying the appropriate container, pouring the beverage in a suitable receptacle, and serving the beverage. Spillage often occurs and is particularly exacerbated if the user is a child trying to cope with the relative large size of the bottle. Additionally, attendant waste is likely to occur since frequently more bottles than necessary are opened. Even where bottles containing carbonated beverages only partially consumed are recapped, the remaining liquids become less effervescent due to escape of the constituent gas into the now larger ullage volume of the bottles. Thus, it is very desirable that the opened bottles be consumed in close time proximity of opening and that other bottles be kept in reserve until actually needed.

There have been numerous attempts to cope with this nettlesome problem through the use of beverage dispensers that dispense the beverage selectively and maintain a seal on the container to preserve the freshness of the liquid during the selective dispensing operation. One example is found in U.S. Pat. No. 4,722,463 issued Feb. 2, 1988 to Anderson. The Anderson patent describes an apparatus containing a spring biased plug element that has an annular groove with a significant axial length. The plug element is axially movable through the manual manipulation of a lever. The groove communicates with both the interior of the bottle and a spout mechanism when a lever cams the plug into an open position. The spout mechanism is used to divert and direct the flow of a liquid into an awaiting receptacle such as a glass. Release of the lever causes the plug to return to its closed position under the bias exerted by the spring, taking the annular groove out of communication with the spout. The beverage in the bottle is caused to change direction several times while flowing under gravity from the container to the spout. For example, the beverage must flow from the bottle into the groove, out of the groove into the spout, and then into the glass. Carbonated beverages, however, are adversely affected when the downward moving liquid impacts various internal barriers to the flow, causing it to release its carbonation. Due to the small diameter and volume of the passageways within the prior art dispenser, considerable build up in the gas pressure can occur quickly causing a rapid expulsion of the gas and a concomitant noise. If the venting passageways cannot accommodate quickly enough the gaseous equilibration between the ullage volume of the container and the atmosphere, the liquid itself may be expelled through the liquid passageways under pressure causing splatter and undesirable quantities of foam.

Still another example is found in U.S. Pat. No. 4,715,516 issued Dec. 29, 1987 to Salvail. This patent recognizes the desirability to allow the gas in the ullage volume of the bottle to equilibrate prior to allowing the liquid to flow out of the bottle. The sequence is accomplished through the use of valves opening and closing the passageways between the bottle and the spout egress from the dispensing apparatus to the awaiting beverage receptacle. Each valve is separately spring biased into the closed position and are opened sequentially by a lever camming against the bottom of the valve stems. The valve stem of the vent passageway is longer than the valve stem of the liquid passageway and is contacted by the lever prior to contact with the liquid valve stem, thus allowing the pressure in the ullage volume to equilibrate prior to the liquid being allowed to egress. It should be noted, however, that the structure of the Salvail device, like that of the Anderson dispensing device, requires the liquid to abruptly change direction at least twice as it flows toward the spout. Again, the abrupt change in direction of the liquid caused by the impact thereof against various internal members results in the constituent gas in the unstable carbonated liquid to be undesirable released prior to consumption, giving rise to excess foam and flat tasting beverages. Salvail further is typical of prior art devices in which the liquid and air mix at a point somewhere in the device, causing carbonated liquids to cavitate and prematurely release its carbonation.

Salvail also describes a stand, typical of other prior art stands, that is connected to the bottle about its neck. It is noted that the stand is subjected to considerable torque due to the displacement of the center of gravity from the point of contact with the stand. This represents a possible unstable condition as the stand and bottle can easily be tipped over by outside forces. Additionally, it may be difficult to accommodate bottles of different dimensions.

It is therefore one object of the present invention to provide for a beverage dispensing apparatus for the rapid flow of beverage from bottle to receptacle without undue creation of foam or causing the beverage to taste "flat".

It is still another object of the present invention to provide for a beverage dispenser for the sequential, unimpeded equilibration of the ullage volume of a container and the unimpeded dispensing of the liquid therein in a direct unimpeded vertical flow to the receptacle.

It is a further object of the present invention to provide for a beverage dispenser that is compact and provides for liquid and venting chambers large enough to ensure that the pressure in the ullage volume is fully dissipated before the liquid is permitted to flow to the receptacle.

It is still a further object of the present invention to provide for a beverage dispenser capable of accommodating and dispensing liquid from an open and inverted beverage bottle that is vertically positioned above a receptacle.

It is still another object of the present invention to provide for a combination stand and beverage dispenser in which the stand directly supports a dispenser that is sealed to the opening of an inverted bottle containing a beverage.

SUMMARY OF THE INVENTION

To accommodate the objects of the invention listed above, an apparatus for dispensing liquids directly from a vertically oriented inverted container containing a liquid comprises a body adapted to receive and secure the open mouth of the container. The body further defines a pair of spaced chambers with a first chamber communicating directly through the mouth with the liquid in the container and the second chamber communicating directly with the ullage volume of the container via a hollow tube-like member. The body further defining first and second spaced passageways that communicate with the respective chambers. The first passageway is vertically aligned beneath said first chamber so as to permit unimpeded flow of liquid therethrough when open. A pair of valves is adapted to selectively open and close the first and second passageways. Finally, a valve control mechanism is operative linked to the valves and sequentially opens the second valve and then the first valve. The sequential operation permits the unimpeded equilibration of the pressure in the ullage volume prior to the unimpeded dispensing of fluid from the bottle to the awaiting receptacle.

Still another feature of the present invention is a stand used in combination with the beverage dispenser that connects directly to one or more beverage dispensers and permits one or more bottles to be inverted and positioned substantially vertical with respect to the horizontal for the dispensing of liquids. The stand includes an upright column mounted on a pedestal positioned on a horizontal support surface such as a counter top. A pair of arms mounted to the top of the upright member extend horizontally outward from the column in opposite directions. Each arm is bent so as to form a rounded right angle bend creating forward extending arm portion. The distal ends of the forward extending portions are bifurcated into pairs of spaced and parallel fingers, thus providing a yoke-like dispenser grasping member. The spacing between the fingers of the member is large enough to allow the dispenser to slide therebetween. The dispenser is provided with a pair of flanges, the underneath surface thereof resting against the top surface of the fingers thereby providing a support for the dispensing apparatus and the connected bottle. Because the stand directly supports the body of the dispensing apparatus, it is independent of the size and shape of the bottle and accommodates the use of all sizes of bottles.

Other objects of the present invention will become readily apparent to those skilled in the art from the following description and appended drawing wherein there is shown and described a preferred embodiment of the present invention. As it will be realized, the invention is capable of other and different embodiments, and its several details are capable of modifications in various, obvious aspects, all without departing from the invention. Accordingly, the drawing and descriptions will be regarded as illustrative in nature and not as restrictive.

DETAILED DESCRIPTION OF THE PREFERRED EMBODIMENT

Figure 1:
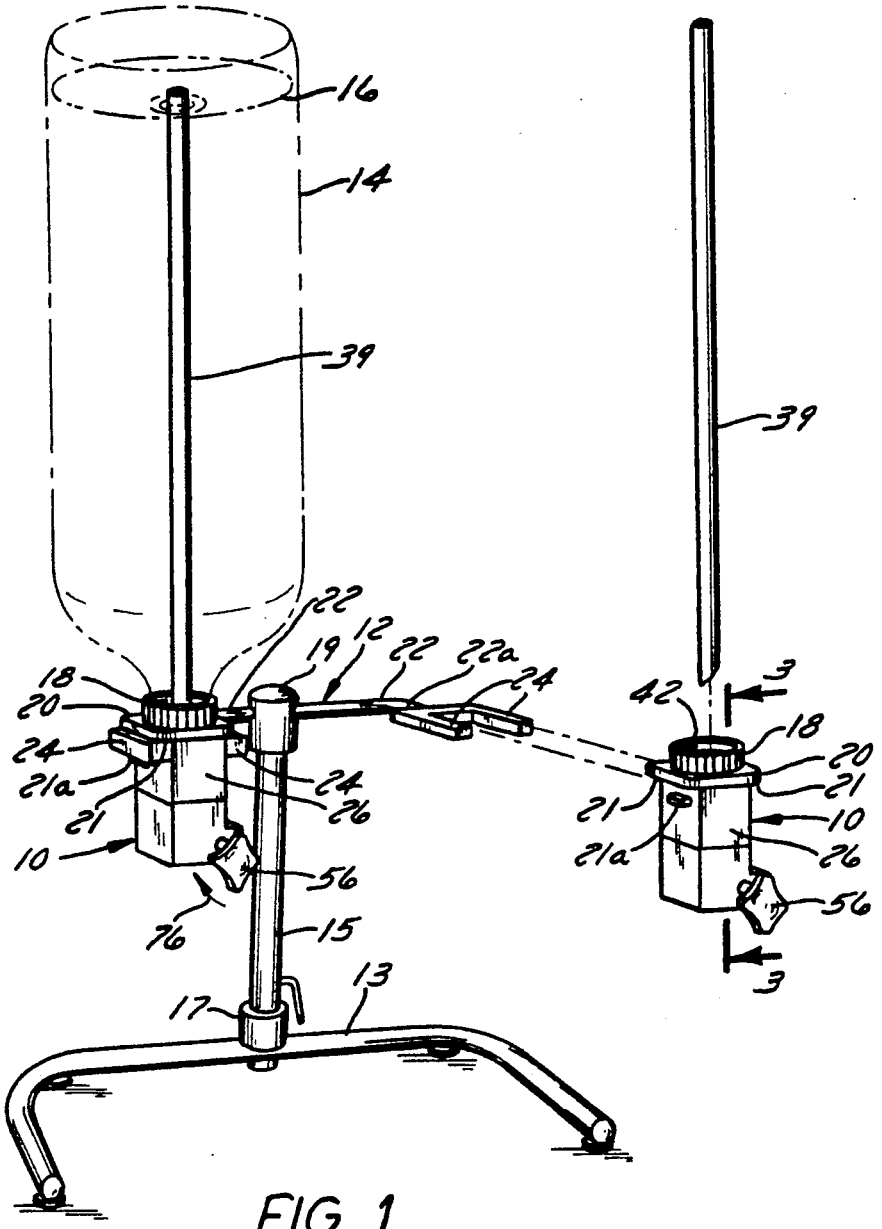
FIG. 1 is a perspective of the dispensing apparatus of the present invention in combination with a stand.

As illustrated by FIG. 1, a pair of dispensing apparatus 10 are supported by a stand 12. One apparatus 10 is connected to an inverted bottle 14 with its sealing cap removed and contains a liquid 16. While FIG. 1, for clarity shows a single bottle in position, stand 12 is capable of two dispensing apparatus 10, each adapted to be connected to a bottle. The open mouth of bottle 14 is secured within annular boss or collar 18 fixed to top wall 20 of apparatus 10. Collar 18 is provided with internal threads to mesh with the external threads about the throat of bottle 14.

Top wall 20 extends beyond the body 26 to form a flange 21. Spaced beneath flange 21 a predetermined distance is a second flange or ridge **21*a* (best seen in FIG. 2). As discussed below, flange 21 serves as a supporting element of apparatus 10 by stand 12. Ridge 21*a* prevents accidental tipping of bottle 14 and apparatus 10 when positioned on stand 12**.

Figure 1A:
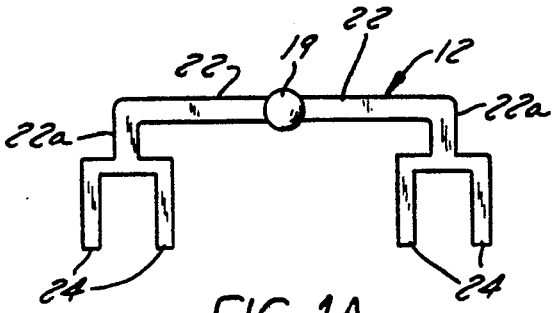
FIG. 1A is a top view of the stand of FIG. 1.

Stand 12, adapted to be positioned on a horizontal surface by C or U-shaped pedestal 13, supports apparatus 10 and indirectly bottle 14 through dispenser 10. A vertical support column 15 is removably secured at its lower end within adjustable socket connection 17 located at the midpoint of pedestal 13. Extending in opposite directions from removable sleeve member 19 encapsulating the top end of column 15 are a pair of arms 22. As best shown in FIG. 1A, each arm 22 is bent at a right angle forming parallel but horizontal arm extensions **22*a*. The extensions 22*a* are bifurcated at the distal ends thereof into a pair of spaced and parallel fingers 24 forming a yoke. The spacing between fingers 24 is sufficiently large to permit the opposite walls of dispensing apparatus 10 to slide therebetween and permitting the dispensing apparatus to be supported on fingers 24 by flange 21. The second flange 21*a* is spaced beneath flange 21 a distance slightly greater than the vertical width of fingers 24**.

A major advantage of the combination is that the dispensing apparatus 10, and not bottle 14, is supported directly by stand 12. Because the bottle 14 is held in a vertical position, not only saving space and more efficiently using the force of gravity for dispensing purposes, the prior art problem of torque exerted on the stand by the center of gravity of the bottle being displaced from the central axis is avoided. Stand 12 provides a stable base for one or more bottles 14 that is not easily tipped over by the user. A second pair of flanges or extensions **21*a* (shown in dashed lines) positioned below the flanges 21 may be provided to prevent a tilting of the bottle 14 and apparatus 10**.

While the figures herein disclose the use of a stand 12 in which the dispenser grasping yoke has a shape to accommodate a dispensing apparatus having a rectangular cross section, other yoke shapes may be employed as well depending upon the shape of the dispensing apparatus. For example, the cross section of the dispensing apparatus could be a circle in which the yoke would have a complimentary shape, i.e., a circle. Additionally, the stand could be provided with a single arm projecting forward and split into a pair of subarms, each bifurcated into a yoke configuration for supporting a dispensing apparatus. Additionally, the stand could be provided with a multiplicity of arms, each with a dispenser grasping yoke, thus accommodating a multiplicity of dispensers and associated bottles.

Figure 2:
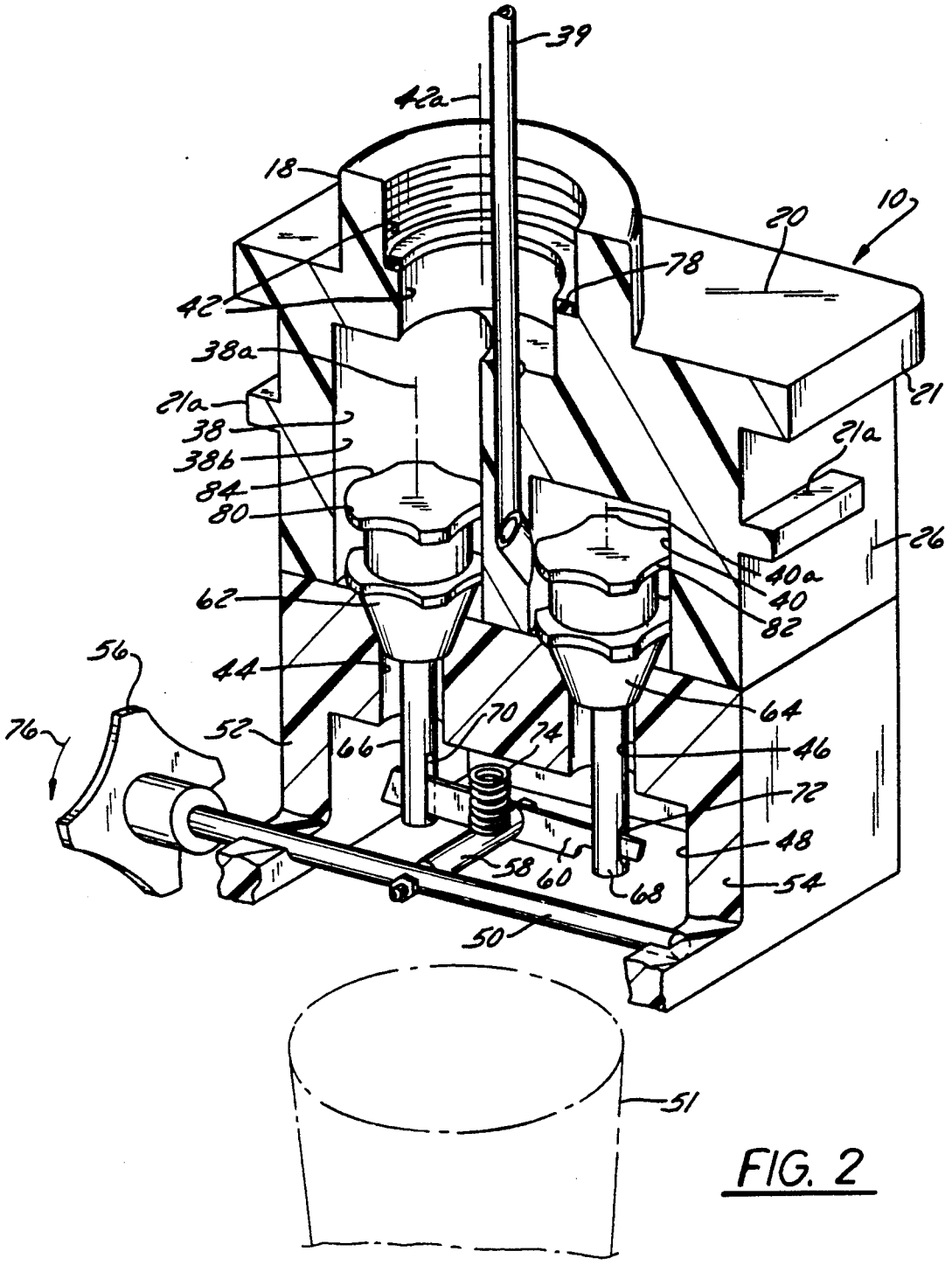
FIG. 2 is a sectional view of the dispensing apparatus of FIG. 1.

The schematic of FIG. 2 illustrates the operative components of the dispensing apparatus of the present invention in a simplified perspective. The body 26 of the apparatus 10 defines a pair of spaced chambers 38 and 40, preferably cylindrical, having respective longitudinal axis 38*a* and 40*a* thereof arranged vertical with respect to the horizontal support surface when apparatus 10 is secured to stand 12 as shown in FIG. 1. Chamber 38 communicates at its upper end with mouth or opening 42 defined by collar 18 and receives liquid from beverage bottle 14. Chamber 40, however, is sealed about hollow tube 39 at its upper end, communicating solely through tube 39 with the ullage volume of bottle 14. At its lower end, chamber 38 communicates with passageway 44 leading to an open cavity 48 defined by the extension of the sidewalls of the dispensing apparatus 10. Similarly, chamber 40 is open at its lower end and communicates with passageway 46 that also leads to cavity 48. Passageway 44 has a vertical axis 42*a* which is essentially coaxial with axis 38*a*, this allowing the liquid to flow downwardly unimpeded from chamber 38 through passageway 44 when open into cavity 48. Thus, passageway 38 and chamber 44 define a vertical channel extending from mouth or opening 42 to opening or cavity 48. Positioned below opening 48 is a receptacle 51 for receiving the liquid passing through the vertical channel. From a review of FIGS. 1, 2, 3, and 5, it may be seen that hollow tube 39 is eessentially parallel and closely positioned to vertical axis 42*a*. Thus, tube 39 extends straight through the liquid 16 when dispensing device 10 is being screwed to the mouth of the container 14 and thus there is little linear movement of tube 39 relative to liquid 16 during the rotation motion involved when attaching dispensing device 10.

It is important that the volumes of the chambers communicating with the container and ullage volume be maximized to the greatest extent possible within the constraints imposed by the dimensions of the body. Thus, chambers 38 and 40 collectively have volumes preferably greater than one half, to about two thirds, of the volume of the section of body 26 defining the chambers. The large volumes of the chambers permit large volume flows of liquid and rapid expansion of gases accumulated in the ullage volume without a detrimental impact on the flow of the liquid and an undesirable liquid and gas expulsion noise along with attendant spraying effect. Selective release of the accumulated gas by careful opening of the valves is not necessary as is prevalent with prior art dispensing devices.

Cavity 48 serves primarily to house the various operative components of the dispensing apparatus. Shaft 50 spans the width of cavity 48 and is rotatably journaled into and supported by opposing walls 52 and 54 of cavity 48. One end of shaft 50 extends through wall 52 and is connected to a manually operated handle 56. A cross bar 58 is secured substantially normal to shaft 50 at about the midpoint thereof and extends across the depth of cavity 48 where it is secured substantially normal at its other end to an arm 60 at about the midpoint thereof.

A pair of tapered valve plugs or elements 62 and 64 are positioned respectively in the complimentarily tapered mouths of passageways 44 and 46. Elements 62 and 64 are preferably made from elastomeric material compatible with the liquid contents of bottle 14 such as thermoplastic material acceptable for use in the food and beverage industry and suitable to seal the mouths of passageways 44 and 46 against fluid flow. Extending downwardly from elements 62 and 64 are respective valve stems 66 and 68 coupled by respective slots 70 and 72 to the ends of arm 60. Slot 70 vertically is larger than slot 72 providing stem 66 a lost motion coupling with arm 60. A spring 74 is connected to cross bar 58 and biases cross bar 58 downwardly, thus via connecting arm 60 and valve stems 66 and 68, pulling valve elements 62 and 64 downward against the mouths of passageways 44 and 46. Passageways 44 and 46 are therefore normally sealed against fluid flow.

Figure 3:
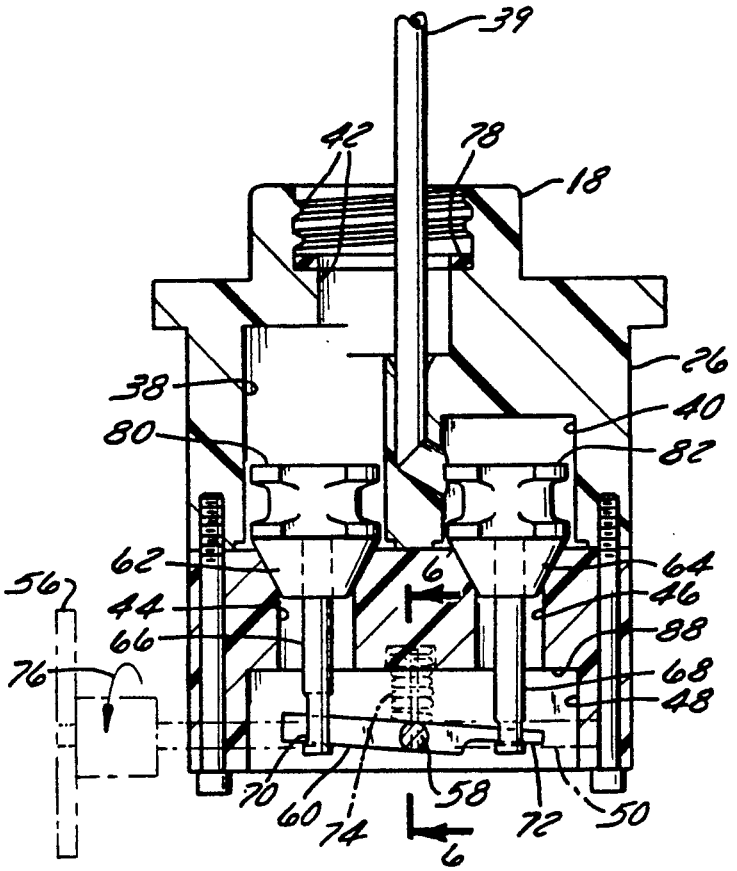
FIG. 3 is a side sectional view of the apparatus of FIG. 1 taken along lines 3—3 thereof.

Before handle 56 is turned, it may be seen from a brief review of FIGS. 2 and 3 that arm 60 rests against the bottom of slots 70 and 72 due to the bias exerted by spring 74. When handle 56 is rotated clockwise, however, as shown by arrow 76 in FIGS. 1 and 2, arm 60 is rotated in the direction of the tops of slots 70 and 72. Because slot 70 is vertically longer than slot 72, arm 60 will first abut the top of slot 72, moving stem 68 and associated valve element 64 up and providing initial communication between the ullage volume and the atmosphere through now connecting chamber 40, passageway 46 and cavity 48. The pressure in the ullage volume will quickly equilibrate with atmospheric pressure before valve element 62 is raised. When valve element 62 is raised, liquid will flow directly downward through chamber 38 and passageway 44 container 51 unimpeded and without any change of direction of the liquid. The operating components offer very little resistance to the flow of the liquid and surprisingly create minimal foam when the liquid is carbonated. It should also be noted that the dispensing apparatus requires no spout to further direct the flow of liquid to a container.

Once container 51 is filled to a desired level, handle 56 is released. Spring 74 under compression causes cross bar 58 to move downward, thus causing valve elements 62 and 64 to return to their sealed positions in the mouths of passageways 44 and 46.

Figure 7:
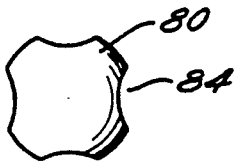
FIG. 7 is a top plan view of a single valve guide.
Figure 5:
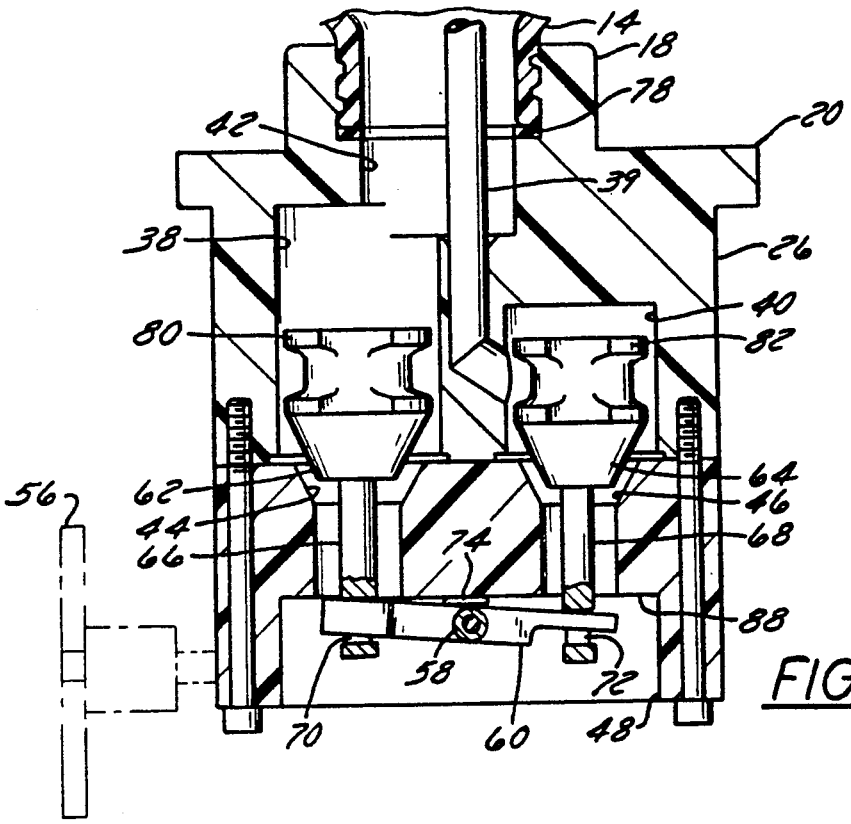
FIG. 5 is a side view of the apparatus of FIG. 1, partially in section, showing the valve elements and stems and depicting the lost motion linkage with the arm.

Referring now to FIG. 3 it may be seen that each valve element 62, 64 is provided with a respective valve guide 80 and 82 that has a diameter slightly less than the diameter of the respective chamber 38 and 40 in which it is positioned. When valve elements 62 and 64 are moved, guides 80 and 82 prevent "off axis" motion of the valve elements. FIG. 7 shows a top elevation view of guide 80. It can be seen that the configuration will allow for the free flow of liquids through spaces 84 between the wall 38*b* of chamber 38 and guide 80. The structural relationship of guide 80 with respect to wall 38*b* is clearly shown in FIG. 2.

Figure 6:
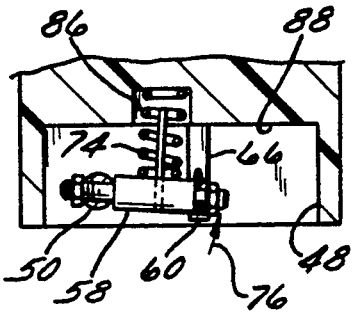
FIG. 6 is a sectional view taken along lines 6—6 of FIG. 3.
Figure 4:
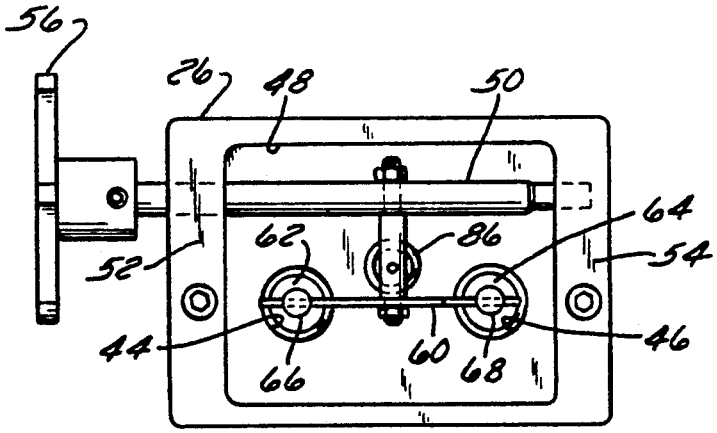
FIG. 4 is a bottom view of the apparatus of FIG. 1 to show the operative components therein.

FIG. 6 illustrates the spring biasing feature of the present invention. One end of helical spring 74 is secured within bore 86 in the top wall 88 of cavity 48 and the other end to cross bar 58. Thus, as seen in FIG. 3, when handle 56 is turned clockwise, cross bar 58 compresses spring 74 into bore 86 where the stored potential energy is available to move cross bar 58 back once handle 56 is released. It should be understood that the type of spring may be varied as desired. For example a leaf spring could be employed requiring little structural modification. Additionally, the spring could be mounted so as to create the bias through extension of the spring rather than through compression.

Figure 8:
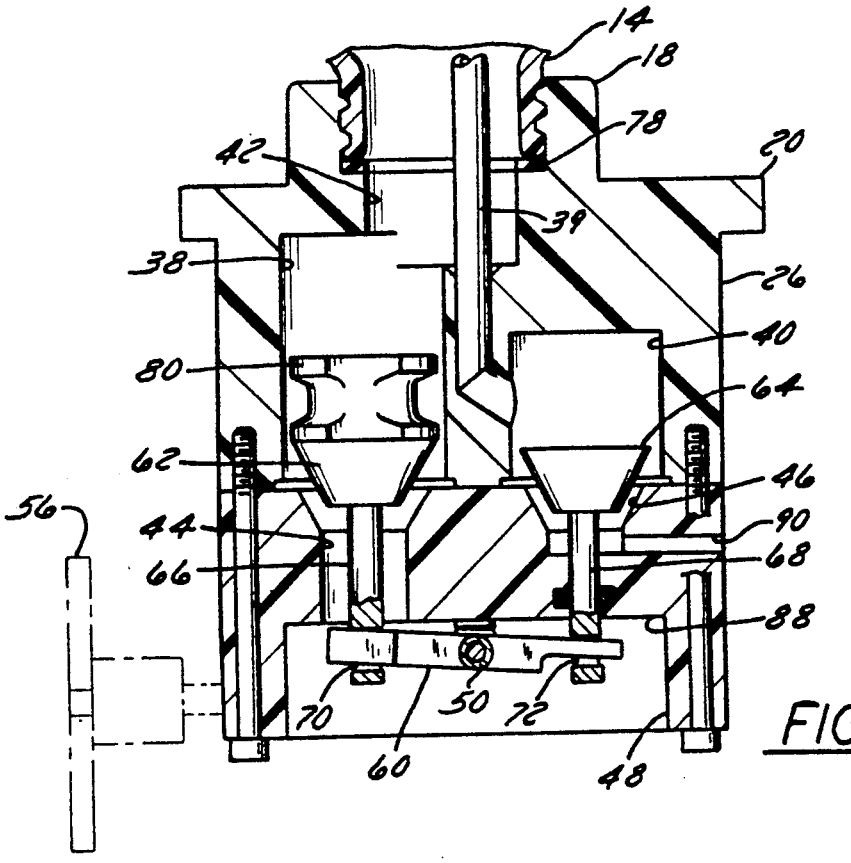
FIG. 8 is a sectional view similar in nature to FIG. 5, showing an alternate structure of the valve chamber in communication with the ullage volume of the bottle and having an opening through the side wall thereof to the atmosphere.

FIG. 8 illustrates an alternate structure of the present invention in which the ullage equilibration is accomplished through the use of a separate hole to the atmosphere into cavity 48. Passageway 46 is sealed from cavity 48 by upper wall 88 of cavity 48. As illustrated, valve stem 68 slides through upper wall 88. However, a small hole 90 permits passageway 46 to communicate with the atmosphere. When valve element 64 is raised, ullage volume can effectively equilibrate as before. An advantage of this structure is that the valve guide for element is not needed since stem 68 is effectively constrained for vertical movement only by wall 88.

From the above it can now be appreciated that dispensing apparatus and stand therefore of the present invention provide considerable advantages. First, because the liquid flows vertically downwardly essentially unimpeded from bottle to awaiting glass, little foam is generated in contrast to many prior art devices. Additionally, the operating components housed within open cavity 48 are easily reachable and cleanable. Finally, none of the operating components require sealing against channeling of the liquid in undesirable directions since all are housed within an open cavity and do not extend through walls containing a flow of liquid.

In this disclosure, there is shown and described only the preferred embodiment of the invention, but it is understood that the invention is capable of changes and modifications within the scope of the inventive concept as expressed herein.

I claim:

1. An apparatus for dispensing liquid directly from a vertically oriented inverted container containing a liquid positioned above said apparatus to a receptacle positioned directly below said apparatus, said apparatus comprising (a) a body having an open top end adapted to receive and secure the open mouth of said container, said body defining (i) a channel defining an essentially straight path for liquid flow from said mouth to a bottom opening directly above said receptacle such that when said body is secured to the vertically inverted container said straight path provides for the direct vertical flow of a liquid, said channel adapted to be selectively opened and closed to the passage of liquid, and further including a first chamber adapted to communicate with the liquid in said container and a first passageway positioned beneath and in substantial longitudinal axial alignment with said first chamber, said first passageway in selective communication with said first chamber, being open directly to the atmosphere, and communicating with said bottom opening directly above the receptacle for said liquid thereby providing a vertically downward, substantially unimpeded, flow of the liquid in said channel without substantial change of direction from said container to said receptacle when channel is open and (ii) a second chamber spaced from said first chamber and adapted to communicate with the ullage volume within said container and a second passageway in selective communication with said second chamber, said second passageway being in communication with the atmosphere, and (b) first and second valve elements removably disposed in respective seated positions in said first and second passageways thereby normally closing said passageways against the passage of liquid and gas between said container and the respective bottom opening and atmosphere; and (c) a valve control device secured to said body for movement between a closed position and an open position, said valve control device operatively connected to said valve elements for sequentially removing said second and then said first valve element from respective seated positions when moved to said open position thereby permitting the equilibration of air pressure in the ullage volume with atmospheric pressure and the subsequent vertically downward, substantially unimpeded, flow without substantial change of direction of the liquid from the container through said vertical channel and said opening, said valve control device returning said valve elements to said seated positions when moved to said closed position.

2. The apparatus of claim 1 including means for biasing said valve control means into said closed position.

3. The apparatus of claim 1 wherein each valve element includes a valve stopper and a valve stem fixed at one end to said stopper and positioned in a respective passageway, said valve stem extending the length of its respective passageway being coupled at the other end to said valve control means.

4. The apparatus of claim 3 in which said body defines an open cavity beneath said first and second passageways and said valve control means comprises a shaft mounted for rotary movement across and within said cavity, a cross bar substantially normal to and fixed at one end to said shaft, and an arm substantially normal to said cross bar and fixed to the other end of said cross bar, said valve stems having vertical slots adapted to receive the respective ends of said arm therein, said first valve element stem having a slot vertically longer than the slot in said second valve element stem, and biasing means for biasing said cross bar in a direction away from said passageways thereby causing said arm ends to bear against the bottom of said respective slots.

5. The apparatus of claim i including valve guides positioned in said chambers and attached to said valve elements for guiding said valve elements in substantially vertical direction when moved by said valve control means.

6. The apparatus of claim 1 in which said body defines an open cavity beneath said first and second passageways and said second passageway is in communication with said cavity.

7. The apparatus of claim 1 in which first and second chambers have a collective volume greater than about one-half the volume of said body.

8. The apparatus of claim 1 in which said body defines an open cavity in communication with said bottom opening and said second passageway is in communication with the atmosphere through a tunnel in the body of said dispensing apparatus from said passageway to the atmosphere and is sealed from said cavity.

9. The apparatus of claim 1 in which said apparatus includes a hollow tubular member attached to said body, in gaseous communication with said second chamber at one end thereof, and extending substantially vertically upward and in gaseous communication with the ullage volume of said container at the other end thereof.

* * * * *